US005785827A

United States Patent [19]

Dougherty

[11] Patent Number: 5,785,827

[45] Date of Patent: Jul. 28, 1998

[54] EDGE PROTECTOR FOR REFINING PLATES

[76] Inventor: Robert C. Dougherty, 937 W. Los Alamos, Tucson, Ariz. 85704

[21] Appl. No.: 797,541

[22] Filed: Feb. 7, 1997

[51] Int. Cl.[6] ..... C25C 7/00; C25C 7/08

[52] U.S. Cl. ..... 204/267; 204/279; 204/281

[58] Field of Search ..... 204/227, 281, 204/267

[56] References Cited

U.S. PATENT DOCUMENTS

| | | | |
|---|---|---|---|
| 1,470,883 | 10/1923 | Schuh | 204/281 |
| 2,115,004 | 4/1938 | Bitner | 204/267 |
| 3,804,724 | 4/1974 | Bolger et al. | 204/281 X |
| 4,207,147 | 6/1980 | Babin | 204/281 X |
| 4,776,928 | 10/1988 | Perlich | 204/281 X |

*Primary Examiner*—Donald R. Valentine

[57] ABSTRACT

An improved electro-refining plate and system which uses the same, in which each electro-refining plate has an edge protector covering the edge of the plate which is exposed to the mineral solution. The edge protector is non-conducting and is secured to the plate using heat and pressure to fuse the edge protector to itself through a series of holes positioned along the edge of the plate. In the preferred embodiment, the edge protector is composed of a ultra-high molecular weight polyethylene. Some embodiments of the invention also use rubber gaskets between the edge protector and the plate; still other embodiments employ an adhesive in conjunction with the fusing action.

16 Claims, 4 Drawing Sheets

EDGE PROTECTOR FOR REFINING PLATES

BACKGROUND

This is a continuation-in-part of provisional patent application entitled "SXEW AND ELECTRO-REFINING EDGES" filed Aug. 5, 1996, and assigned the Ser. No. 06/023,177.

This invention relates generally to mining and more particularly to the extraction of metals from ore in liquid suspension.

In a typical situation, metals (including copper, nickel, or zinc) are extracted from ore using large metal sheets, usually of titanium or stainless steel which are suspended in tanks containing copper, very strong sulfuric acid, plus other chemicals. The metal sheets are used as cathodes to electro-deposit metals on their surface.

In Solvent Extraction-Electro Winning (SXEW), the copper is leached out of the copper bearing ore using sulfuric acid. The acid containing the copper drains to a collection system (pumps, pipes), ending up in tanks containing the large metal plates. Low voltage/high amperage direct current electricity is applied, using the sulfuric acid solution as the anode, and the titanium/stainless steel plate as the cathode. The copper is electro-deposited (plated) on the metal to a pre-determined time/thickness, removed from the acid/copper solution, cleaned and the deposited copper is stripped off.

In Electro-Refining, an impure copper anode from a smelter is immersed in sulfuric acid along with a titanium or stainless steel cathode plate. Again, a low voltage/high amperage direct current is applied between the anode and cathode, and ultra-pure copper is electro-deposited on the metal cathode, then cleaned and stripped at the appropriate time/thickness.

In both operations, the deposited copper must not be allowed to plate around the side edges or the bottom of the cathode to form an attached copper bridge between the two deposited copper sides. If the copper does bridge around both sides, the cost in time and labor to remove the copper increases considerably.

To alleviate this problem, suppliers have designed and fabricated various edge strips of CPVC, HDPE, Sponge/Spring combinations, etc., and the refiners have added other innovations such as wax dips, silicone RTV, plus others. The edge strips break due to rough handling, copper getting underneath the strips, impact, age, chemical attack, etc. Protection such as wax, silicone, etc., must be re-applied each cycle; these are messy and create occupational and safety hazards, plus increasing production costs. When the edge strips break, the removal of the deposited copper is a major problem, plus the broken strips must be replaced, increasing production costs again.

It is clear that there is a need for an improved edge protector for refining plates.

SUMMARY OF THE INVENTION

The present invention creates a highly improved system for electro-refining by creating an electro-refining plate. This refining plate has an edge protector covering the edge of the plate which is exposed to the mineral solution. The edge protector is non-conducting and is secured to the plate using heat and pressure to fuse the edge protector to the plate and to itself through a series of holes positioned along the edge of the plate.

The metal plate has a series of openings or holes through which the edge protector material is forced, using heat and pressure, so that the edge protector itself is fused to itself. This fusing using heat and pressure provides an excellent seal between the edge protector and the plate itself; further, the fusing through the holes provides excellent support for the edge protector during use.

In the preferred embodiment, the edge protector is composed of a Ultra-High Molecular weight Polyethylene (UHMP). This material is beneficial in that it is non-conducting, doesn't degrade in the toxic environment of electro-refining, and is durable to take the rugged treatment demanded.

While ultra-high molecular weight polyethylene is the preferred material, those of ordinary skill in the art readily recognize a variety of other materials such as TEFLON, NYLON, polyvinyl chloride, and chlorinated polyvinyl chloride, which will serve in this capacity.

Some embodiments of the invention also use rubber gaskets between the edge protector and the plate to provide additional sealant to prevent the mineral solution from seeping between the edge protector and the metal plate and becoming deposited onto the metal plate.

Still other embodiments of the invention employ an adhesive in conjunction with the fusing action to increase the bonding between the metal plate and the edge protector while also increasing the sealing action therebetween.

The present invention uses a fusion bonded polymer edge member which is formed in one continuous piece around both sides and the bottom of the plates. The preferred polymer is either a thermo plastic or thermo set polymer. These polymers are flexible yet shock/impact resistant and extremely tough, with high resistance to chemical deterioration and aging. Examples of such polymers include, but are not limited to: TEFLON, NYCON, High Density Polyethylene (HDPE), chlorinated polyvinyl chloride (CPVC), and Ultra-High Molecular Weight Polyethylene (UHMWPE). The preferred polymer is UHMWPE as our primary material as it is the best trade-off of requirements versus cost.

The material selection for the edge member may change due to copper production variations such as chemical solution composition, process temperatures, stripping techniques, etc.

The polymer is fused to itself through penetrations in the side and bottom edges of the metal. These penetrations are in the form of round holes, ellipses, square slots, oblong slots or other geometric shapes.

In applying the polymer to the cathode, ideally the polymer is melted on both surfaces of the plate while the polymer is under pressure; then while still under pressure, cool the polymer down so that it becomes one piece along the edge and through the slots. This fusion locks the polymer in place, so it may not be removed from the plate without tearing the melted/fused section apart.

The metal plates used as cathodes are subjected to heavy physical abuse, being stripped on a schedule from once/day to once/every 7 days. During stripping, they are hammered and bent, cleaned by live steam and on occasion are left in the steam cleaning booth for over twenty minutes. Standard edge strips crack under bending and hammering, get copper plated under them and/or are torn off during copper removal. They cannot be used on the bottom edge, as copper would plate under them and they would be torn off during the stripping operation. Therefore, the mining operations now use wax or silicone, this is very messy and dangerous (wax)

and expensive (silicone). When the copper wraps around an edge or bottom, the stripping operation stops until the copper is removed.

Since the edge member of this invention is formed as one piece, both around and through the metal blank, it is tough yet flexible and very resistant to chemicals, and it is very cost effective.

The invention, together with various embodiments thereof, will be more fully illustrated by the accompanying drawings and the following description.

DRAWINGS IN BRIEF

FIGS. 1A, 1B, and 1C are side views illustrating the application of the invention's edge protector to a metal plate.

Figure 7:
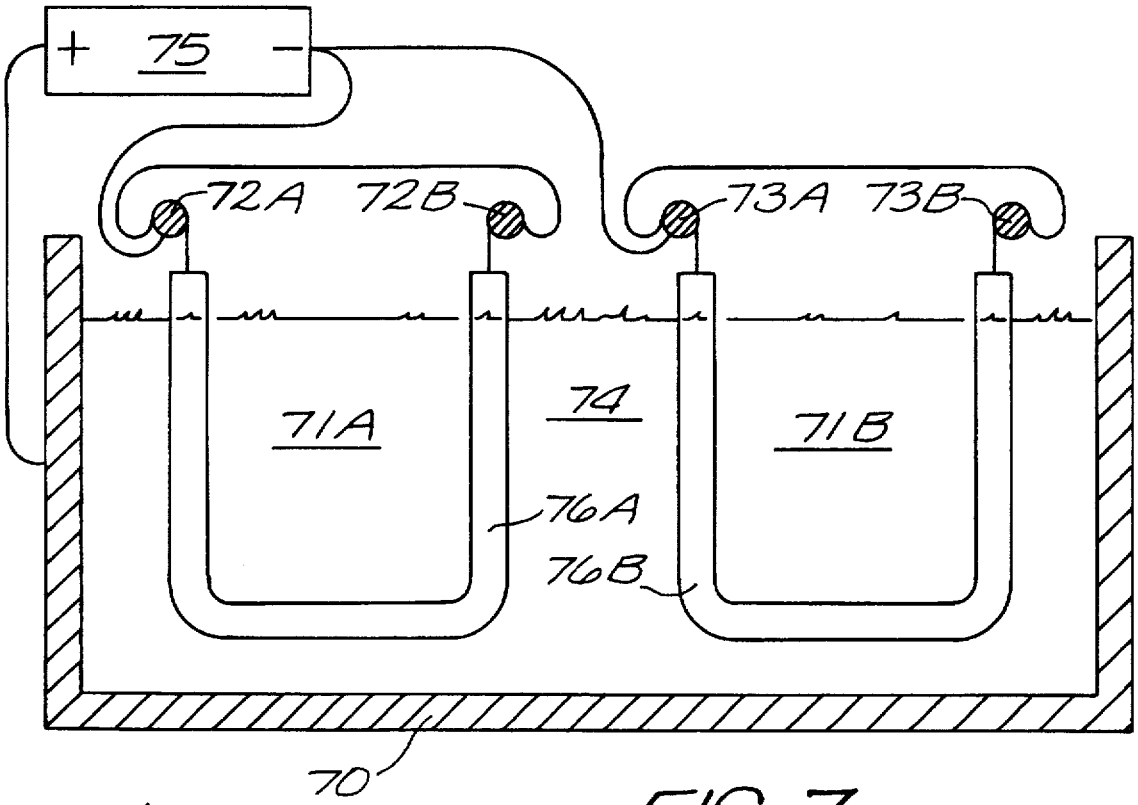

FIG. 7 diagrams the use of the electroplating plates in an electroplating system.

Figure 8:
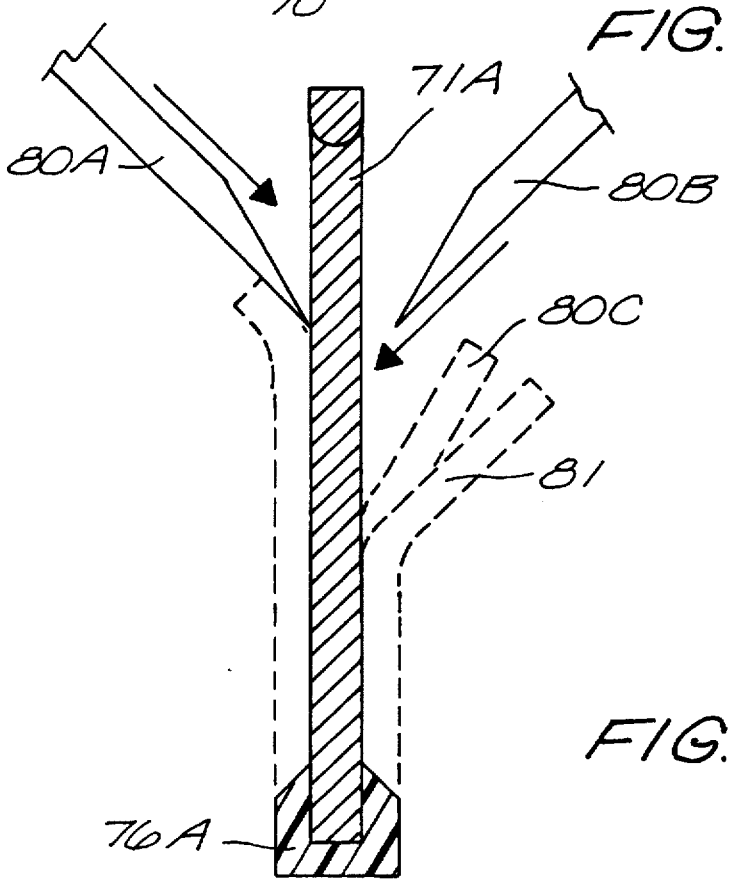

FIG. 8 is a side view illustrating the preferred embodiment's removal of deposited materials from the electroplating sheet.

DRAWINGS IN DETAIL

Figure 1A:
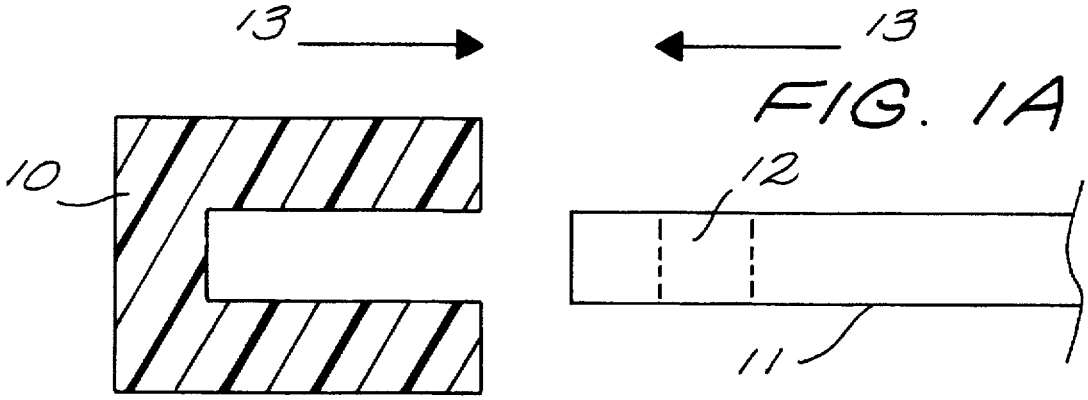
FIG. 1D illustrates the use of a gasket or rubber seal to further seal the joint between the edge protector and the metal plate.
Figure 1B:
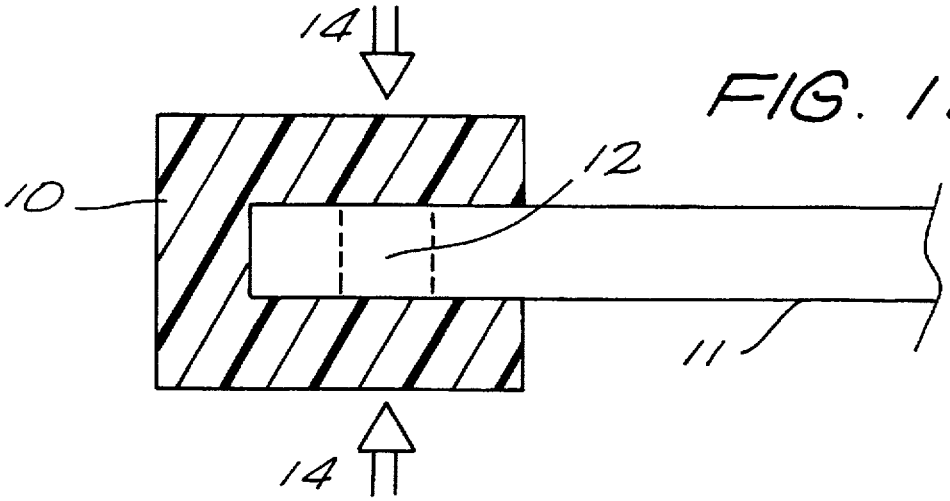
Figure 1C:
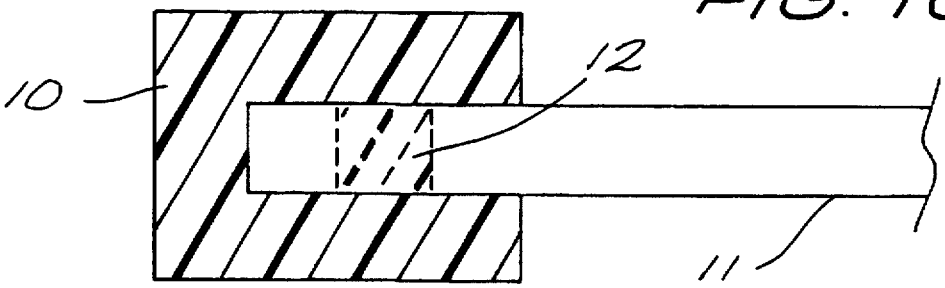

FIGS. 1A, 1B, and 1C are side views illustrating the application of the invention's edge protector to a metal plate.

Referring to FIG. 1A, edge protector 10 is generally "U"shaped and is placed over the edge of metal plate 11 as indicated by arrows 13. Along the edge of metal plate 11 are various holes 12 over which edge protector 10 extends as shown in FIG. 1B.

Once placed over metal plate 11, heat and pressure 14 is applied to the edge protector 10 which fuses the edge protector to itself through hole 12 as shown in FIG. 1C. The heat and pressure also provides for a good seal between edge protector 10 and metal plate 11.

In one embodiment of the invention, an adhesive is placed over the edge of metal plate 11 prior to placement of edge protector 10 thereon. The adhesive provides added adhesion and sealing between edge protector 10 and metal plate 11.

Figure 1D:
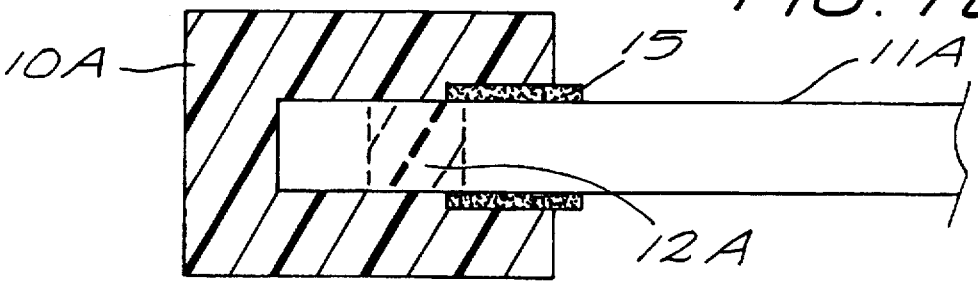

FIG. 1D illustrates the use of a gasket or rubber seal to further seal the joint between the edge protector and the metal plate.

As discussed before, edge protector 10A is inserted over an edge of metal plate 11A so that hole 12A is enclosed therein. In the embodiment shown in FIG. 1D, edge protector 10A is shaped to accept a rubber seal 15 so that when edge protector 10A is pressed and heated to creating the fusing activity discussed before, rubber seal 15 provides further sealing action between the two elements to prevent the minerals from being deposited between the edge protector 10A and the metal plate 11A.

The preferred composition of edge protector 10A is ultra-high molecular weight polyethene which provides the durability and insulation capabilities sought.

Figure 2:
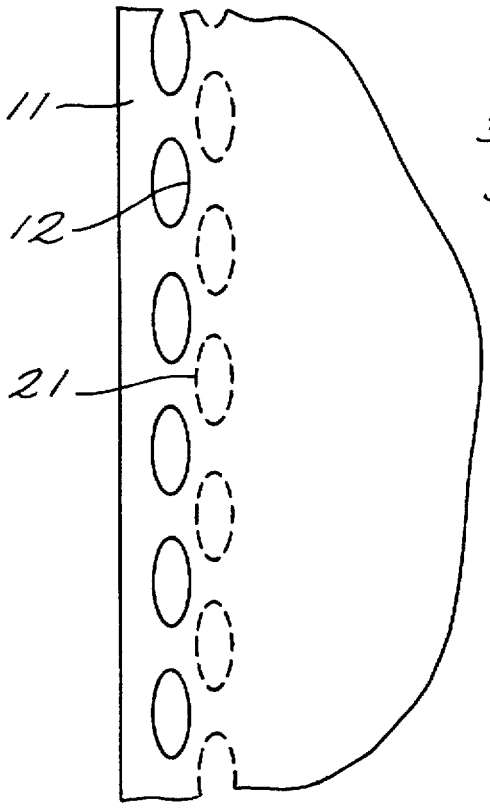
FIG. 2 is a side view of the preferred embodiment of the metal plate illustrating the slots used for securing the edge protector.

FIG. 2 is a side view of the preferred embodiment of the metal plate illustrating the slots used for securing the edge protector.

Metal plate 11 is configured with holes 12 positioned proximate to an edge of metal plate 11. In this preferred embodiment, holes 12 are elongated to provide for added fusing areas between the walls of the edge protector (not shown). In another embodiment, circular holes are used instead of the slotted approach.

In still another embodiment of the invention, holes 12 are not aligned with each other in a linear relationship, but, rather are arranged in a rank arrangement in which a first rank is followed by a second rank as shown by optional holes 21. This configuration provides for additional sealing and physical adhesion to metal plate 11.

Figure 3:
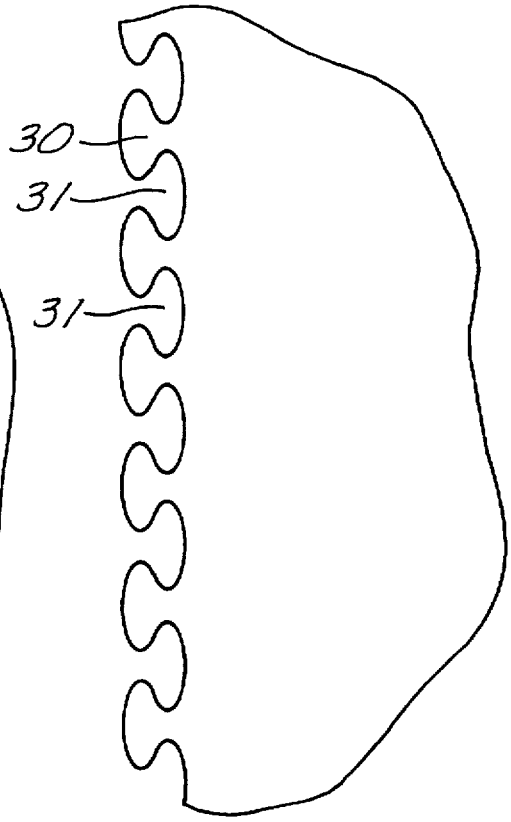
FIG. 3 is a side view of an alternative embodiment of the metal plate illustrating the use of shaped openings for securing the edge protector.

FIG. 3 is a side view of an alternative embodiment of the metal plate illustrating the use of shaped openings for securing the edge protector.

In this embodiment, metal plate 30 has openings 31 positioned along three of its edges. Openings 31 are configured to be partially encircled by portions of metal plate 30; this configuration of openings 31 provides that the fused edge protector has a sufficient mechanical grip with metal plate 30 to withstand the abuse the edge protector must endure during normal use within the electroplating operation.

Figure 4A:
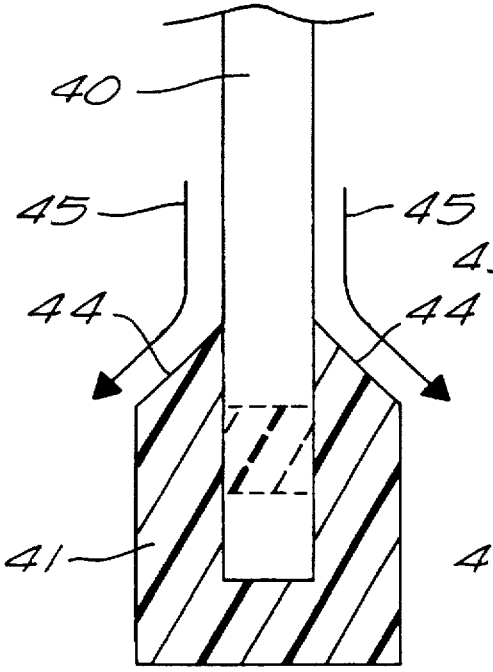
FIGS. 4A and 4B are side views of the preferred edge protector's shape for use on the lower portion of the metal plate showing the discharge of debris from the metal plate and the collection of the targeted materials onto the metal plate.
Figure 4B:
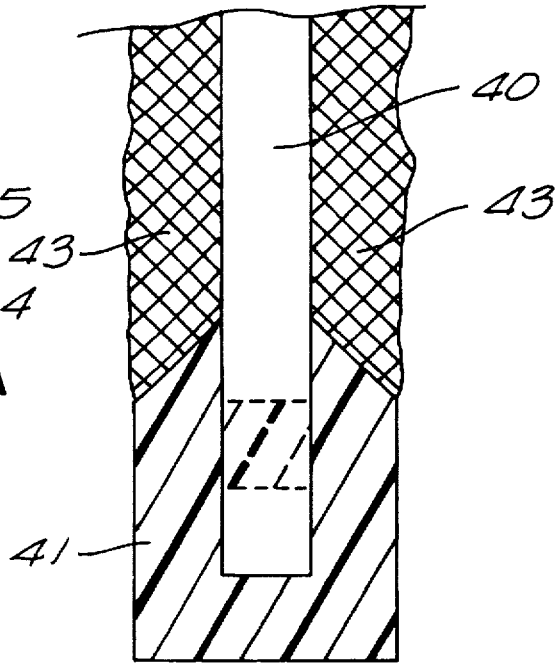

FIGS. 4A and 4B are side views of the preferred edge protector's shape for use on the lower portion of the metal plate showing the discharge of debris from the metal plate and the collection of the targeted materials onto the metal plate.

Referring to FIG. 4A, metal plate 40 has edge protector 41 fused thereto. The upper shoulder 44 of edge protector 41 is sloped away from the faces of metal plate 40 so that precipitating material, illustrated by arrows 45, are directed away from the faces of metal plate 40 to precipitate to the bottom of the tank.

As shown in FIG. 4B, in this manner, the selected metal 43 is deposited onto metal plate 40 during the normal deposition process. Note that the non-conductive nature of edge protector 41 prevents the deposited material from extending around the edge of metal plate 40 so that the deposited material is easily removed after the electrodeposition process.

Figure 5:
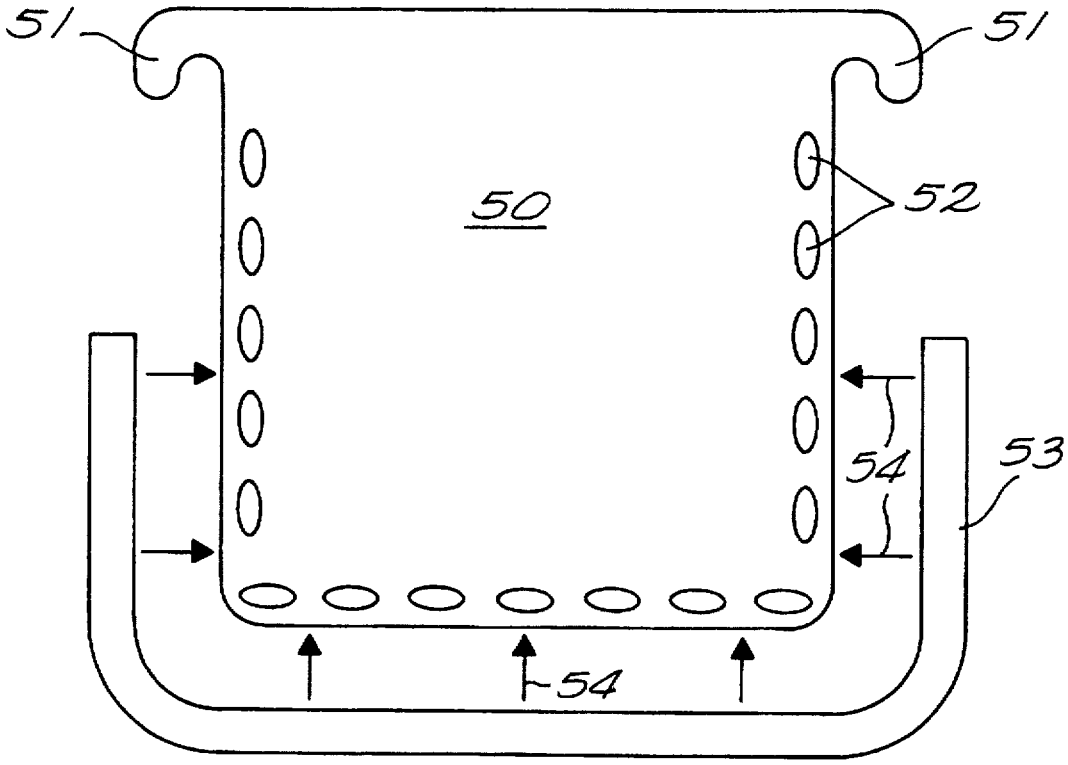
FIG. 5 illustrates an embodiment of the invention in which the edge protector is a single piece which is wrapped around selected edges of the metal plate.

FIG. 5 illustrates an embodiment of the invention in which the edge protector is a single piece which is wrapped around some of the metal plate.

This illustration shows the support mechanism 51 which is positioned to provide support for metal plate 50 during the electroplating procedure. As before, holes 52 are arranged along three edges of metal plate 50.

In this embodiment, a single strip of edge protector 53 is secured to the selected edges of metal plate 50 as indicated by arrows 54. Edge protector 53 is simply pressed around the edges and then fused to itself as discussed earlier.

Figure 6:
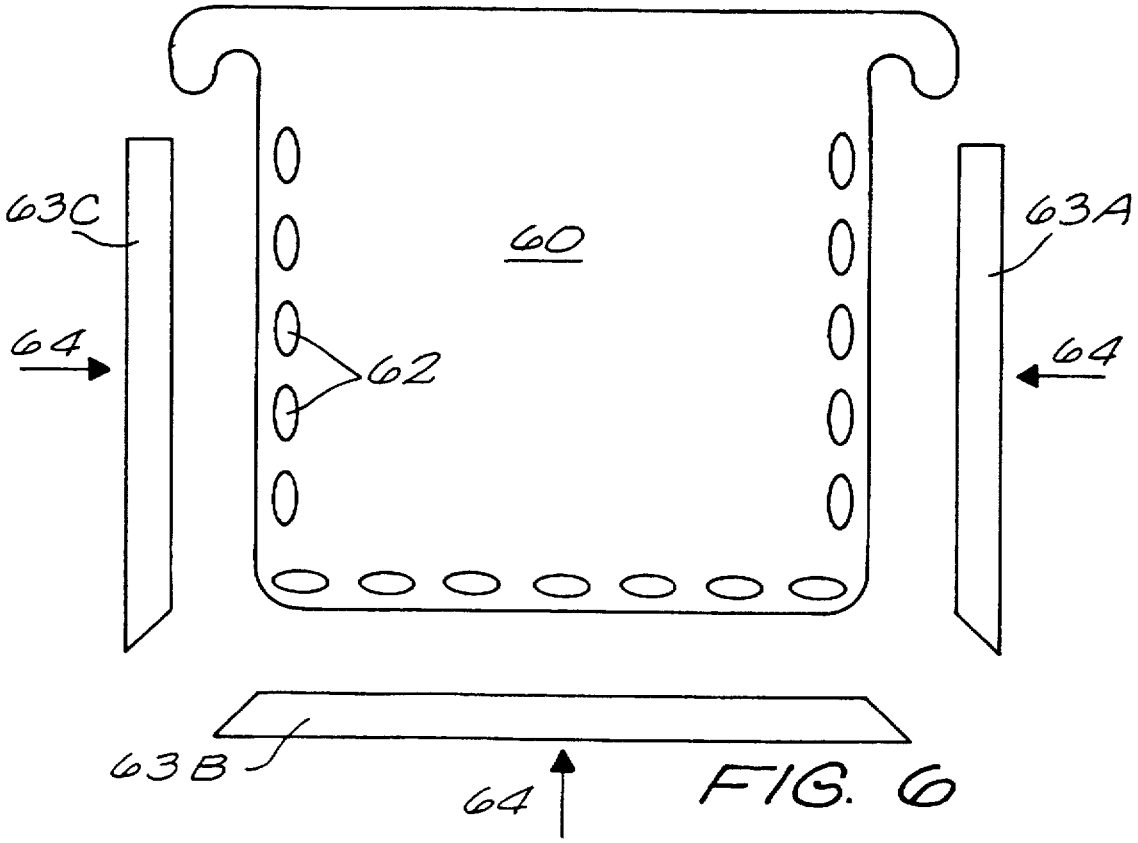
FIG. 6 illustrates the preferred embodiment of the invention illustrating the use of three members for the creation of the edge protector onto the metal plate.

FIG. 6 illustrates the preferred embodiment of the invention illustrating the use of three members for the creation of the edge protector around the metal plate.

Metal plate 60 has a series of holes 62 around three of its sides. Holes 62 are to be enclosed within the edge protectors 63A, 63B, and 63C which are adapted to abut each other. In this embodiment, segment 63B has two beveled ends which are adapted to mate with a single beveled end of the other edge members 63A and 63C.

Once the three members 63A, 63B, and 63C are properly positioned, they are then subjected to pressure and heat to cause the fusing through holes 62 and also to each other. In this manner, the final result is a continuous edge protector which extends around three sides of metal plate 60.

FIG. 7 diagrams the use of the electro-plating plates in an electroplating system.

The electro-winning system shown in FIG. 7 is a typical electro-refining operation in which refining plates 71A and 71B are placed into a bath 74 of electrically reactive metals. Plates 71A and 71B are supported by rods 72A and 72B, and 73A and 73B respectively. These rods, such as rod 72A, not only support the plate, but also are used to conduct electricity into the metal plate.

Each plate 71A and 71B has an edge protector 76A and 76B on three sides such that the bath 74 is prevented from engaging the edge of either plate.

Electrical current through bath 74 is provide by energy source 75 which is electrically connected with support rods 72A and 73A and also with reservoir 70 (which is in electrical contact with bath 74).

The electrical current causes minerals supported within bath 74 to be deposited onto plates 71A and 71B, but, since edge protectors 76A and 76B are non-conducting, no deposits occur there.

FIG. 8 is a side view illustrating the preferred embodiment's removal of deposited materials from the electroplating sheet.

Once the deposit has reached the desired depth, plate 71A is removed from the bath and knives 80A and 80B engage the deposited material to shear it away from the plate as shown by knife 80C and deposit 81. Since deposit 81 is prevented from passing around an edge of plate 71A, deposit 81 is easily removed without damaging plate 71A.

In some applications, the deposited metals are manually removed from the cathode.

This arrangement for the edge protector, creates a highly improved electro-refining plate for a variety of metals including, but not limited to, copper, zinc, and nickel.

It is clear that the present invention creates a highly improved protective edge for refining plates and the like.

What is claimed is:

1. An electro-refining plate comprising:

a) a substantially rectangular flat metal plate having a uniform thickness throughout and having, 1) a first edge adapted to suspend said rectangular metal plate, and, 2) a second, third and fourth edge having a series of openings there along, said second third and fourth edge being substantially at right angles;

b) an edge protector being substantially U shaped and positioned to overlap and enclose said second, third, and fourth edge of said substantially rectangular metal plate, said edge protector being fused to itself through said series of openings; and, c) a rubber seal positioned between an edge of said edge protector and said substantially rectangular metal plate.

2. The electro-refining plate according to claim 1 wherein said edge protector is a non-conducting material.

3. The electro-refining plate according to claim 2 wherein said non-conducting material is a ultra-high molecular weight polyethylene.

4. The electro-refining plate according to claim 2 wherein said edge protector is a continuous member contacting said second, third, and fourth edge of said substantially rectangular metal plate.

5. The electro-refining plate according to claim 4 further including a layer of adhesive between said substantially rectangular plate and said edge protector.

6. The electro-refining plate according to claim 2 wherein said edge protector includes:

a) a first linear member fused to itself through the series of openings positioned along the second edge of said substantially rectangular metal plate;

b) a second linear member fused to itself through the series of openings positioned along the fourth edge of said substantially rectangular metal plate; and, c) a third linear member fused to itself through the series of openings positioned along the third edge of said substantially rectangular metal plate, said third linear member further fused to said first linear member and said second linear member.

7. The electro-refining plate according to claim 6, a) wherein said first linear member includes a beveled first end abutting said third linear member;

b) wherein said second linear member includes a beveled first end abutting said third linear member; and, c) wherein said third linear member has a beveled first end abutting and fused to the first end of said first linear member, and a beveled second end abutting and fused to the first end of said second linear member.

8. The electro-refining plate according to claim 7 wherein an upper edge of said third linear member is adapted to direct precipitating matter away from a first and a second surface of said substantially rectangular metal plate.

9. The electro-refining plate according to claim 8 wherein said series of openings in said second, third, and fourth edges include a series of holes proximate to said second, third, and fourth edges.

10. The electro-refining plate according to claim 8 wherein said series of openings in said second, third, and fourth edges are partially encircled by said metal plate.

11. An electro-refining system comprising:

a) a container adapted to hold a liquid solution of electrically reactive minerals;

b) an energy source creating an electrical charge;

c) suspension means, electrically connected to said energy source; and, d) a multitude of refining plates suspended from, and electrically connected with, said suspension means and adapted for immersion said liquid solution, each of said refining plates having, 1) a metal plate having a uniform thickness throughout and having, A) a first edge including a bracket adapted to suspend said metal plate by said suspension means, and, B) a second, third and fourth edge having a series of openings therealong, 2) an edge protector being composed of non-conducting material and substantially U shaped, said edge protector positioned to enclose and overlap all of the third edge and a portion of said second and fourth edges of said metal plate, said edge protector being fused to itself through said series of openings, said edge protector further including, A) a first linear member, B) a second linear member, and, C) a third linear member abutting said first linear member and to said second linear member substantially at right angles, and, 3) a seal positioned between an edge of said edge protector and said substantially rectangular metal plate.

12. The electro-refining system according to claim 11 wherein said non-conducting material is a ultra-high molecular weight polyethylene.

13. The electro-refining system according to claim 11 wherein said edge protector is a continuous member contacting said second, third, and fourth edge of said metal plate.

14. The electro-refining system according to claim 13 further including a layer of adhesive between said substantially metal plate and said edge protector.

15. The electro-refining system according to claim 11, a) wherein said first linear member includes a beveled end abutting and fused to said third liner member; and, b) wherein said second linear member includes a beveled end abutting and fused to said third linear member.

16. The electro-refining system according to claim 15 wherein, for each of said refining plates, an upper edge of said third linear member is adapted to direct precipitating matter within said liquid solution away from a first and a second surface of said metal plate.

* * * * *